United States Patent [19]

Patterson et al.

[11] 3,963,556

[45] June 15, 1976

[54] MORTAR CAVITY LINING

[75] Inventors: Harold A. Patterson, Middle Village, N.Y.; Victor Danylik, Dover, N.J.

[73] Assignee: The United States of America as represented by the Secretary of the Army, Washington, D.C.

[22] Filed: July 26, 1974

[21] Appl. No.: 492,083

Related U.S. Application Data

[62] Division of Ser. No. 376,260, July 3, 1973, which is a division of Ser. No. 220,149, Jan. 24, 1972.

[52] U.S. Cl. ..... 156/423; 156/285

[51] Int. Cl.[2] ..... B69D 3/00

[58] Field of Search ..... 102/49.1, 49.2; 156/285, 287, 423

[56] References Cited

UNITED STATES PATENTS

| | | | |
|---|---|---|---|
| 2,838,435 | 6/1958 | Hewett | 102/105 X |
| 3,513,051 | 5/1970 | Lichfield | 156/287 X |
| 3,728,196 | 4/1973 | Rausing | 156/287 X |

FOREIGN PATENTS OR APPLICATIONS

| | | | |
|---|---|---|---|
| 115,431 | 9/1946 | Australia | 102/49.1 |
| 71,223 | 9/1942 | Czechoslovakia | 102/49.1 |
| 72,900 | 3/1944 | Czechoslovakia | 102/49.1 |

*Primary Examiner*—Verlin R. Pendegrass
*Attorney, Agent, or Firm*—Nathan Edelberg; Robert P. Gisbon; A. Victor Erkkila

[57] ABSTRACT

In a separable mortar round of the type having a central cartridge chamber within the boom portion and provided with a plurality of flash holes extending outwardly of the chamber that improvement, which includes an adhesively bonded thin stainless steel foil disposed about the inner wall of the chamber and closing over the flash holes to provide increased liquid impermeability. The method of applying the aforesaid foil to the chamber wall by wrapping a foil on a hollow mandrel having a plurality of surface openings and applying a vacuum to said mandrel while simultaneously wrapping the foil thereabout. Coating both the foil and the inner chamber wall with an adhesive and inserting said mandrel into the separated boom for aligned disposition in the chamber. Thereafter gaseously sealing the mandrel in the chamber, releasing the vacuum, applying positive pressure to the mandrel and removing the same from the chamber.

The invention described herein may be manufactured, used and licensed by or for the Government for governmental purposes without the payment to us of any royalty thereon.

1 Claim, 3 Drawing Figures

MORTAR CAVITY LINING

The invention described herein may be manufactured, used and licensed by or for the Government for governmental purposes without the payment to us of any royalty thereon.

This is a division of application Ser. No. 376,260 filed July 3, 1973, which is a division of application Ser. No. 220,149 filed January 24, 1972.

BACKGROUND OF THE INVENTION

The present invention relates to mortar type munitions and more particularly pertains no structural improvement therein for substantially improving the water resistance and imperviousness thereof without imparting or contributing to any degrading residue.

In the field of mortar munitions and such, it has been the general practice to encase or provide barriers, as are employed in prior art devices, to increase the water resistance of the primer and cartridge of a mortar shell. In general, water or vapor can and does enter a mortar shell through the flash holes to the cartridge or by way of the primer and tunnel. Water resistance of these shells has been improved by physically encasing the ignition cartridge in a plastic wrapping or vapor barrier and by positively sealing the primer structure to the tail assembly. Another technique employed is to provide an external plastic vapor barrier around the outer surface of the mortar and closing off the flash holes. This latter solution necessitates the use of special adhesives wich although satisfactory from a bonding viewpoint, exhibit extremely poor residue properties. On the other hand, even though, only a minimal proportion of residue is generated outside of the mortar, water is still permitted to enter the flash holes. In any event these techniques have proved unsatisfactory while the present invention fills this need and provides a satisfactory solution.

SUMMARY OF THE INVENTION

The general purpose of this invention is to provide a mortar munition that has all the advantages of similarly employed prior art devices and has none of the above described disadvantages. To attain this, the present invention provides a unique improvement in mortar shells wherein there is adhesively bonded to the inner ignition cartridge chamber wall, a single layer of stainless steel foil which also closes over the plurality of flash holes. Additionally, a positive method of foil application includes providing a hollow mandrel having a plurality of surface openings over which the layer of the stainless steel foil is wrapped and retained thereon by application of a vacuum to the mandrel. Adhesive is applied to the inner wall of the cartridge chamber as well as to the outer foil surface. The mandrel, with the overlaying foil, is inserted into the cartridge chamber of the detached mortar boom, in sealing relation, and the vacuum released with the subsequent application of positibe pressure to firmly press the foil into contact with the chamber wall. The pressure is relieved and the mandrel removed to provide a mortar shell wherein the cartridge is positively protected against the entrance of moisture or water into the chamber.

An object of the present invention is to provide an improved mortar round which is water and moisture impervious and which generates only a minimum of residual matter.

Another object is the provision of a simple, inexpensive, easily applied, basic improvement for a mortar type munition to render the shell ignition cartridge water resistant.

Still another object of the instant invention is to provide a readily adaptable technique or method for applying a metallic vapor barrier to the inner wall surface of an ignition cartridge chamber of a mortar shell.

Other objects and many of the attendant advantages of this invention will be readily appreciated as the same becomes better understood by reference to the following detailed description when considered in connection with the accompanying drawings wherein.

A BRIEF DESCRIPTION OF A PREFERRED EMBODIMENT

Figure 1:
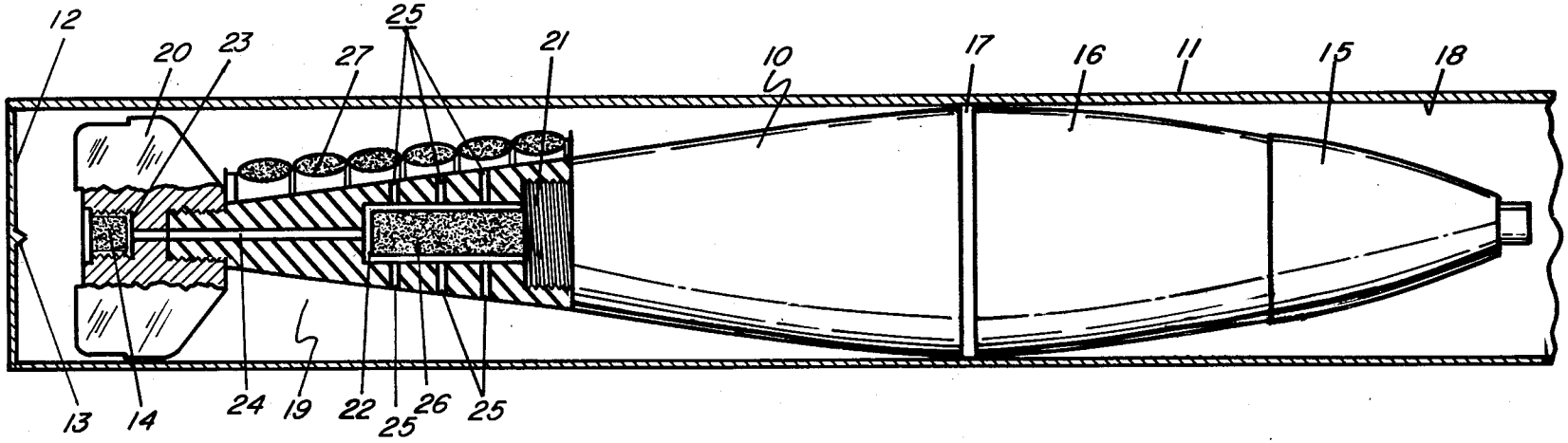
FIG. 1 is a cross-sectional view of a typical mortar round.
Figure 2:
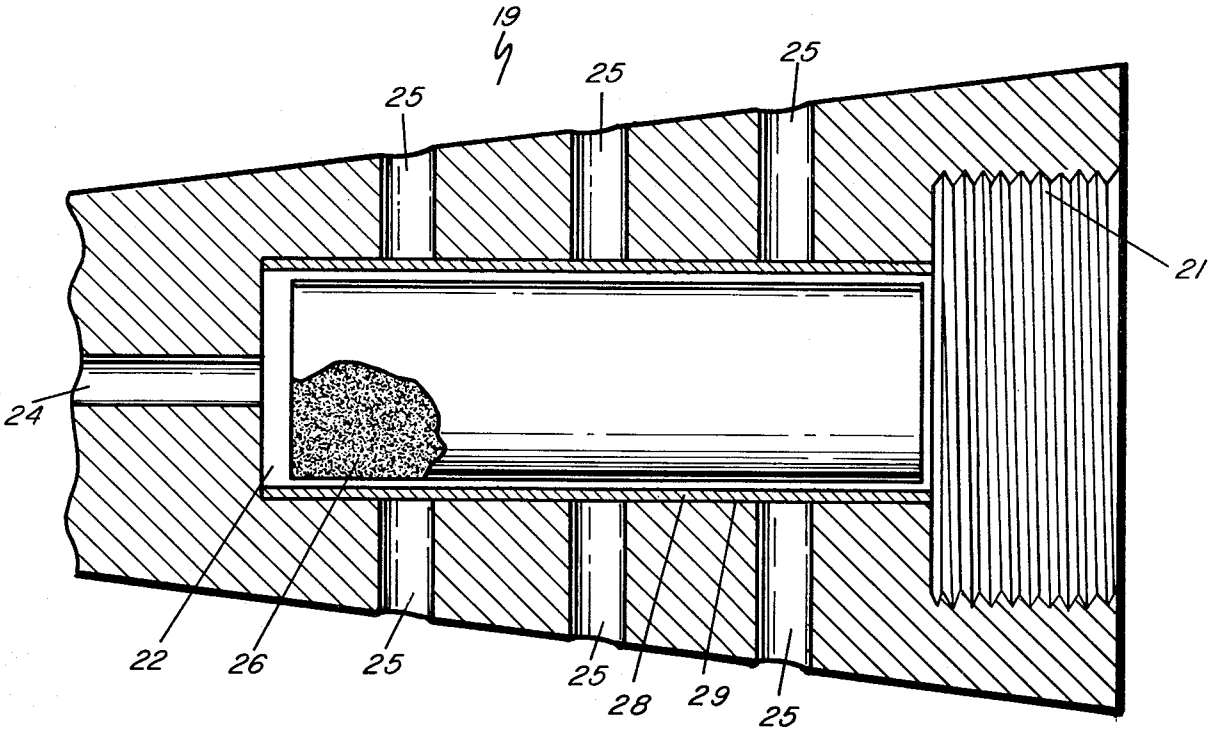
FIG. 2 is an enlarged cross-sectional view of the boom portion of a mortar shell showing the ignition cartridge; and, FIG. 3 is a cross section of a set-up jig for application of the metallic vapor barrier to the cartridge chamber wall.

In the illustrated embodiment of FIG. 1 the mortar shell or munition 10 is disposed in the firing or launch tube 11 with its forward end directed outwardly. The base 12 of the tube carries an initiating means 13 which is positioned to contact and penetrate the primer 14 of the mortar and ignite the same when the shell is dropped down into the tube. The shell can be constructed of aluminum or any other suitable material and includes a forward portion having a fuze system 15 confined therein and with the rear of which there is a plenum or disposition therein of the payload 16 that may be a high explosive, phosphorous etc. Circumscribing the shell at its maximum diameter is an obturator 17 which will slidingly abut the inner launch tube wall 18. The boom portion 19 and the tail fins 20 constitute the terminal portion of the shell. The payload portion is separable from the terminal or boom portion and is releasably secured thereto by mating threads 21.

The boom section is formed with a centrally disposed recess which faces outwardly toward the payload and is generally referred to as the cartridge chamber 22. The closed end of the chamber 22 communicates with the primer plenum 23 through an axial tunnel 24. Additionally, a plurality of flash holes 25 extend outwardly of the chamber 22 to provide direct communication with the shell exterior. With the ignition cartridge 26 seated in its chamber and the primer 14 activated, the resulting primer flash transits the tunnel and activates the ignition cartridge 26. Upon such activation the ignition cartridge generates a hot flash of gases which, under pressure exit through the flash holes and ignite the propellant contained in a plurality of bags disposed intermediate the shell and the launch tube and opposite the flash holes. The ignition and subsequent burning of the propellant creates a volume of high pressure within the confined tube between the obturator and the closed end or base 12 of the tube so as to cause the shell to be propelled out of the launch tube.

It is clear from the foregoing description that from the time of insertion of the ignition cartridge into the shell boom it is exposed to the external environment through the flash holes and water and moisture readily accumulate on or about the cartridge thus degradingly affecting the operation of one launching of the shell and increasing the probability of short rounds. In order to obviate this inherent problem, a stainless steel foil 28 is bonded to the inner cartridge chamber wall by a layer 29 of suitable adhesive. Since it is necessary that the flash generated by the ignition cartridge pass relatively unimpeded to the propellant, the vapor barrier must be extremely thin and yet of sufficient structural strength. In fabrication, it has been found that type 301 stainless steel in foil form and of approximately $3 \times 10^{-4}$ inches thickness provides excellent results. A suitable bonding agent for use between the stainless steel foil and the aluminum housing, is an adhesive mixture designated as LAMINAC 4116 and LYSEROL-DDM, a hardener of about 1% by weight. The LAMINAC resin is basically made up of a group of 100% reactive copolymers and manufactured by the American Cyanimid Company.

Figure 3:
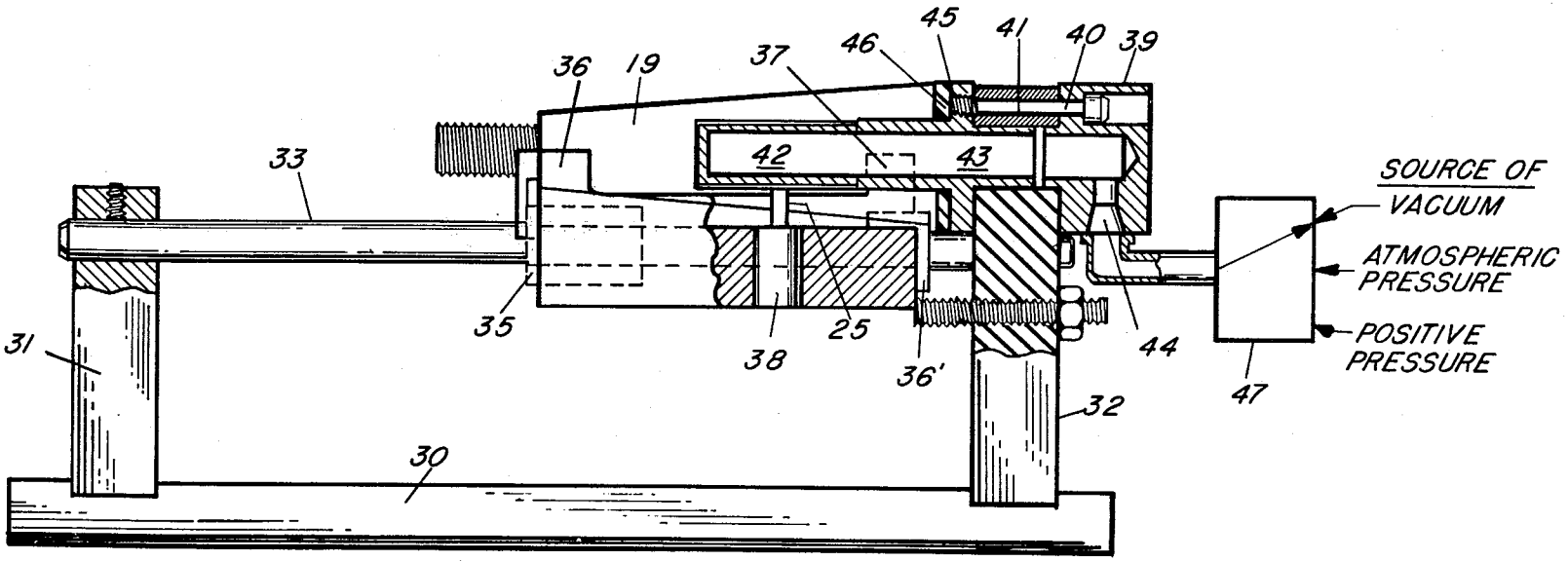

The apparatus for application of the stainless steel foil as illustrated in FIG. 3, includes a bed 30 which supports opposed pairs of upstanding brackets 31 and 32 that in turn support therebetween a pair of shaft guides 33 (only one being visible). A boom cradle 34 provided with a pair of openings extending lengthwise thereof is positioned for movement along said guides which pass therethrough and ride within bushings or bearings 35 and 36' seated within the opening. The cradle also includes a forward 36 and rear 37 upstanding supports which are centrally contoured to hold the boom 19 (fin section deleted). Additionally the cradle carries an index or positioning pin 38 that extends into one of the boom flash holes when the boom is properly seated in the cradle. The rear bracket 32 also supports a stationary mandrel carrier 39 by way of a plurality of bolts 40 and is formed with a central aperture 41 into which is seated the mandrel mechanism. The forward end includes the hollow perforated cylindrical mandrel 42 while a central passageway 43 communicates with an inlet fitting 44. The forward annular abutting wall 45 of the carrier includes an elastomeric annular sealing member 46 and the mandrel is rotatable about its longitudinal axis by a structure not shown. The inlet port 44 is coupled by way of selectable valve 47 to sources of vacuum, positive pressure and atmospheric pressure. In operation the boom is positioned on the cradle while it is furthermost from the mandrel and the foil 28 is singly wrapped about the mandrel with a vacuum applied to retain the foil in this configuration. Thereafter adhesive is applied to both the outer surface of the foil and to the inner boom cartridge chamber wall as by spraying. With the mandrel still under a vacuum the cradle with the boom is laterally directed so that the mandrel is fully inserted into the boom chamber. When so positioned, the vacuum is released and positive pressure is applied blowing out or forcing the foil outwardly away from the mandrel and into positive contact with the chamber wall for a sufficient time period dependent on the particular adhesive properties. Thereafter, the pressure is reduced to atmospheric and the boom withdrawn. It should be noted that positive pressure is maintained within the boom since the outer wall is releasably sealed to the mandrel carrier and the mandrel easily released by rotating the same during removal of the boom. In order to prevent the slight foil overlap or seam to be positioned over a flash hole the system is indexed when the foil is wrapped around the mandrel and by the indexing pin 38.

It should be understood, of course, that the foregoing disclosure relates to only a preferred embodiment of the invention and that numerous modifications or alterations may be made therein without departing from the spirit and the scope of the invention as set forth in the appended claims.

We claim:

1. An apparatus for adhesively bonding a metallic foil with the cartridge chamber of a separable mortar shell having flash holes which comprises:

a support for fixedly holding a mandrel means, a cradle for holding said mortar shell, a pin disposed in and extending out of said cradle for engagement in one of said flash holes, fixedly held guide means for supporting said shell cradle for movement toward and from said mandrel means in alignment for insertion of said mandrel means into said chamber, said mandrel means including:

a hollow perforated mandrel having its interior communicating with an inlet port, and sealing means for providing a gaseous seal between said shell and said mandrel when said shell is disposed on said cradle and said mandrel is disposed within said chamber, whereby said mandrel may be evacuated to retain thereabout an adhesively coated metallic foil, inserted into said chamber, and thereafter have positive pressure applied to blow out said foil against the wall of said chamber.

* * * * *